United States Patent [19]

Furlong et al.

[11] 4,065,235

[45] Dec. 27, 1977

[54] GEAR PUMP

[75] Inventors: Donn Breen Furlong, San Rafael; Dickey Steele Londahl, Walnut Creek, both of Calif.

[73] Assignee: Tuthill Pump Company, San Rafael, Calif.

[21] Appl. No.: 691,904

[22] Filed: June 1, 1976

[51] Int. Cl.[2] ..... F04B 17/00

[52] U.S. Cl. ..... 417/420; 417/310; 418/126; 418/206

[58] Field of Search ..... 417/310, 420; 418/125, 418/126, 129, 206

[56] References Cited

U.S. PATENT DOCUMENTS

| | | | |
|---|---|---|---|
| 110,350 | 12/1870 | Follenshee | 418/125 |
| 367,374 | 8/1887 | Deming | 418/126 |
| 1,783,209 | 12/1930 | Wilsey | 418/129 |
| 2,149,337 | 3/1939 | Deming | 418/125 |
| 2,742,862 | 4/1956 | Banker | 418/126 |
| 3,146,720 | 9/1964 | Henry | 417/310 |
| 3,400,940 | 9/1968 | Conrad et al. | 418/125 |
| 3,516,764 | 6/1970 | Feroy | 418/125 |
| 3,716,306 | 2/1973 | Martin et al. | 417/420 |
| 3,826,938 | 7/1974 | Filer | 417/420 |
| 3,986,800 | 10/1976 | Dworak et al. | 418/126 |

*Primary Examiner*—C. J. Husar
*Attorney, Agent, or Firm*—McWilliams & Mann

[57] ABSTRACT

A magnetically driven, sealed gear pump has hard metal gears and a pair of relatively soft gear tip seals near the pump inlet chamber that compensate for wear of its parts.

5 Claims, 7 Drawing Figures

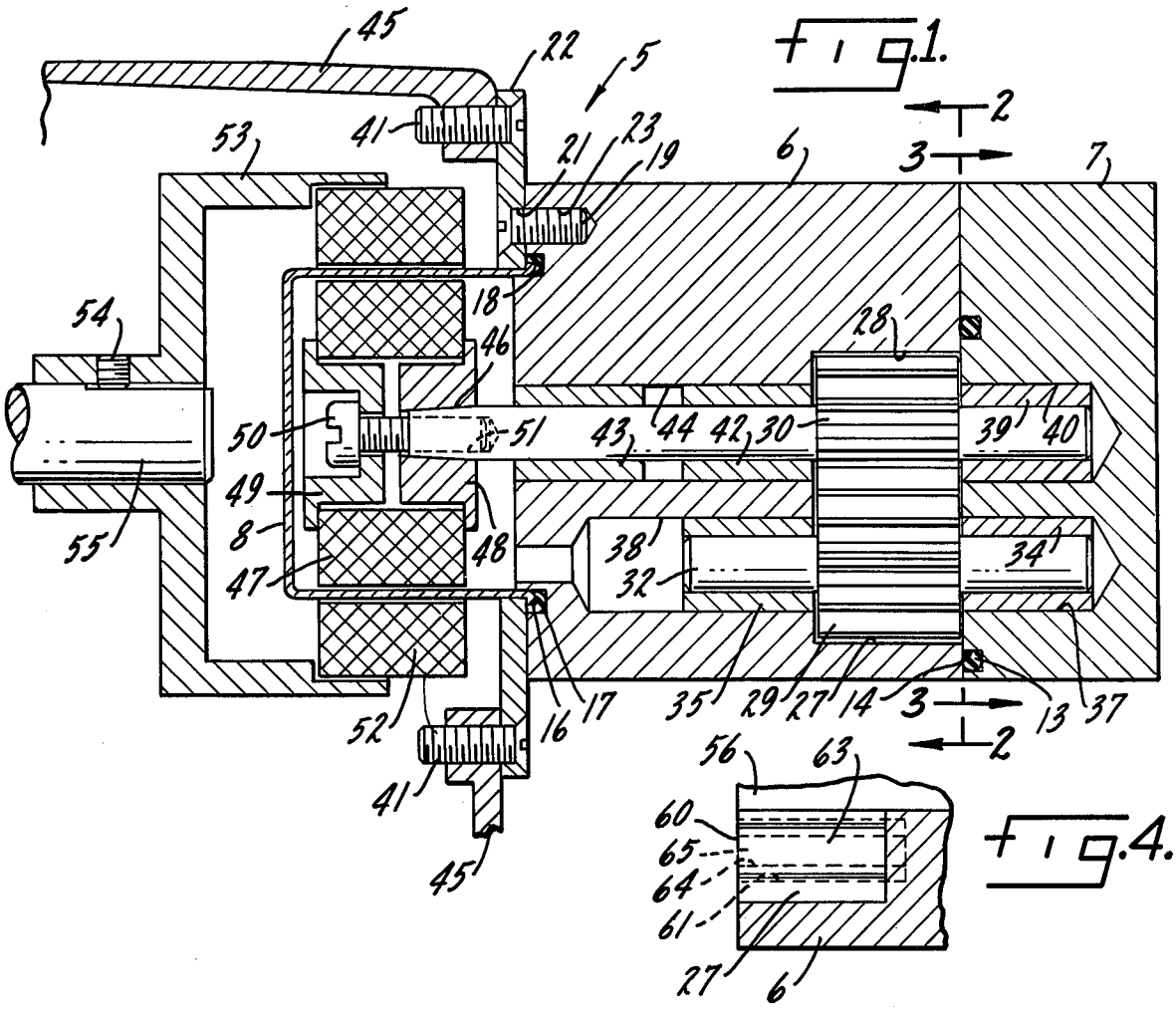
fig.1.
fig.4.
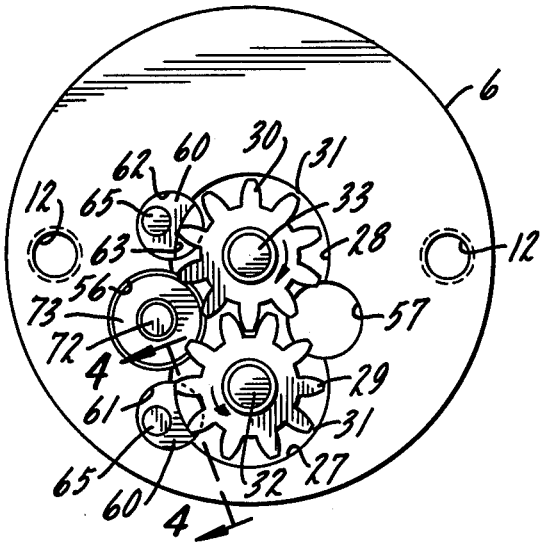
fig.2.
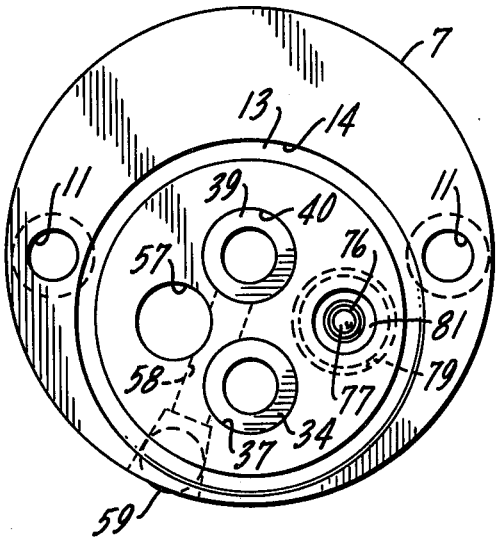
fig.3.

Fig. 5.
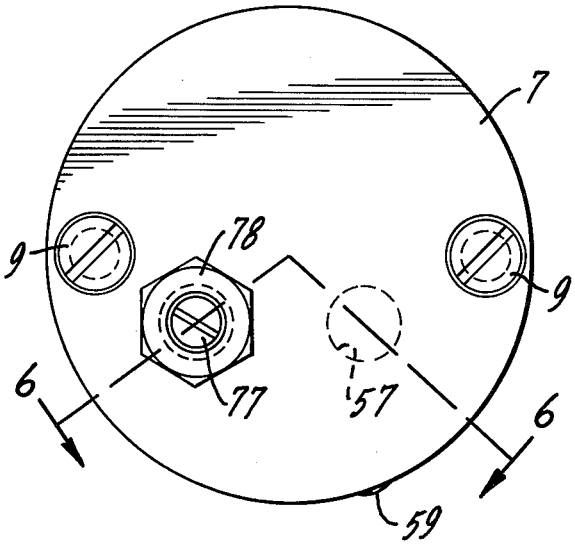
Fig. 7.
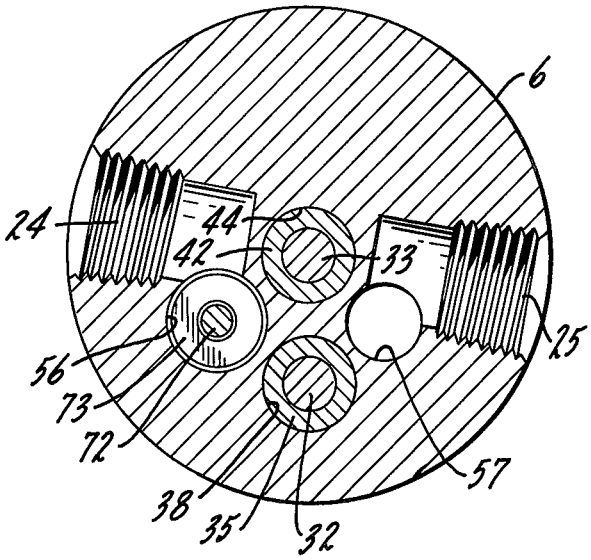
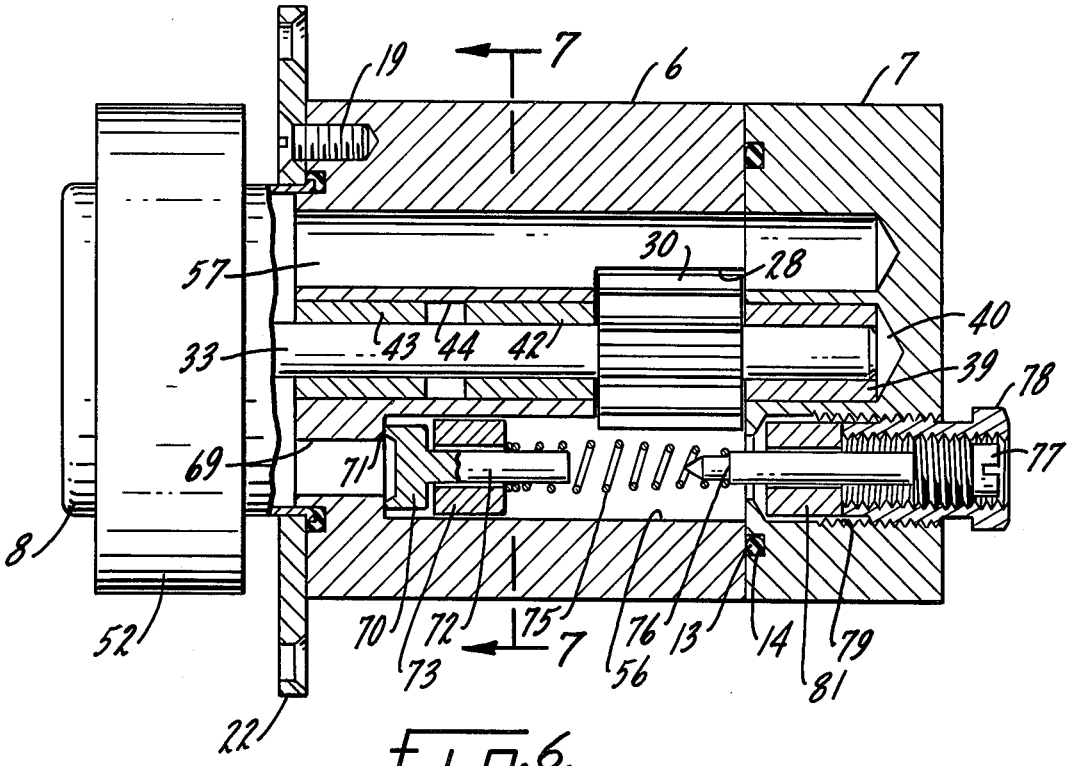
Fig. 6.

GEAR PUMP

BACKGROUND OF THE INVENTION

This invention relates to gear pumps, and more particularly to sealed, leak-proof gear pumps usable with non-lubricating liquids.

Some systems involve the pumping of liquids that can not be permitted to contact the environment, either by leakage into the pump or escape of liquid from the pump. Small precision gear pumps with sealed magnetically coupled drives are usable in many such systems in the chemical, dye, textile, instrumentation, food, drug, and medical fields. Magnetically coupled drives eliminate drive shaft seals, which are a major source of pump leakage and contamination of the liquid being pumped. However, magnetic drive couplings have limited torque capacity. Therefore friction within the pump chamber should be minimized so that an increased amount of such torque capacity can be used for pumping. Prior art magnetically driven gear pumps have attempted to minimize friction by using relatively soft gears made from plastic or carbon; these soft gears are enclosed in a close fitting metal or plastic housing so that wear at the gear tips is relied upon to compensate for manufacturing tolerances and gear shaft bearing wear. However, such soft gears wear out prematurely due to normal tooth loads on the soft material. This leads to leakage between the gear teeth, loss of pressure and pumping capacity, and unnecessary repair expense.

Accordingly, it is an object of this invention to provide an improved gear pump.

Another object is to provide a magnetically-driven sealed gear pump with a reduced internal friction load.

Another object is to provide a precision leak-proof, contamination-free gear pump having increased pumping out-put and pressure capacity.

Another object is to provide a gear pump in which normal wear of the gear shaft bearings does not result in appreciable loss of pressure or output.

Another object is to provide a gear pump in which soft, individually replaceable seals minimize the wear on metal gear teeth.

Another object is to provide a gear pump that is usable with non-lubricating and corrosive liquids over a wide temperature range.

Another object is to provide a sealed, precision gear pump that has a long life, is relatively inexpensive to manufacture, and does not have defects found in similar prior art gear pumps.

Other objects and advantages of the invention will be found in the specification and claims, and the scope of the invention will be set forth in the claims.

DESCRIPTION OF THE DRAWING

FIG. 1 is a cross sectional, partially broken-away view of a preferred embodiment of the invention.

FIG. 2 is an end view taken along the line 2—2 in FIG. 1.

FIG. 3 is an end view, taken along the line 3—3 in FIG. 1.

FIG. 4 is a cross sectional view taken along line 4—4 of FIG. 2.

FIG. 5 is an end view of the pump.

FIG. 6 is a cross sectional view taken along the line 6—6 in FIG. 5.

FIG. 7 is a cross section taken along the line 7—7 in FIG. 6.

DESCRIPTION OF A PREFERRED EMBODIMENT

A sealed gear pump 5 has a body 6, a first end cap 7, and a second end cap 8. End cap 7 is attached to body 6 by screws 9 passing through holes 11 and threaded into tapped holes 12. A pliable circular O-ring gasket 13 in a circular groove 14 seals the space between end cap 7 and body 6. The space between end cap 8 and body 6 is sealed by a flange 16 which compresses a pliable circular O-ring gasket 17 in a circular groove 18 in body 6. Cap 8 is attached to body 6 by screws 19 passing through holes 21 in an adapter ring 22 and are threaded into tapped holes 23, thus locking flange 16 between ring 22 and body 6. An inlet port 24 and an outlet port 25 in body 6 provide the only openings through which liquid can enter or leave pump 5.

Body 6 has a pair of circular overlapping gear cavities 27 and 28 in one end. A pair of essentially identical, circular, toothed metal gears 29 and 30 rotate in cavities 27 and 28. The dimensions of cavities 27 and 28 and gears 29 and 30 are predetermined so that a relatively large clearance space at 31 (e.g., 0.01 inches) is left between the surface of the cavities and the tips of the gear teeth. A rotatable shaft 32 extends through the center of and is attached to gear 29, and a rotatable shaft 33 extends through the center of and is attached to gear 30. The ends of shafts 32 are rotatably received in sleeve bearings 34 and 35, which are held in holes 37 and 38. One end of shaft 33 is rotatably received in sleeve bearing 39, which is held in a hole 40 in cap 7, and the other end of shaft 33 is rotatably received in sleeve bearing 42 and 43, which are held in a hole 44 in body 6. Holes 38 and 44 vent through body 6 to the inside of end cap 8. Gears 29 and 30 are made from a hard, durable, corrosion-resistant metal, such as grade 316 stainless steel, or non-galling chrome-nickel alloy. Unless indicated otherwise, other parts of pump 5 are made from durable corrosion-resistant metal, such as stainless steel. Bearings 34, 35, 39, 42 and 43 are made from a self-lubricating material such as grade 102-45 nickel chrome alloy Metalized Carbon, that is softer than the material from which gears 29 and 30 shafts 32 and 33 are made.

A tapered end 46 of shaft 33 projects beyond body 6 into end cap 8 where an annular, driven magnet 47 is attached thereto by a pair of flanged clamps 48 and 49 which are held in place by a screw 50 threaded into a tapped hole 51. An annular drive magnet 52 surrounding end cap 8 is held in a hub 53 which is attached with set screw 54 to the drive shaft 55 of power supplying means such as an a.c. electric motor. Energization of such a motor rotates shaft 55 and drive magnet 52, which causes rotation of driven magnet 47 in a well known manner. Thus shaft 33 is rotated causing rotation of gears 29 and 30, even though pump 5 has no moving parts with seals exposed to the atmosphere. An adapter moulding 45 attached by screws 41 may be used to support pump 5 on the motor housing (not shown).

A liquid inlet channel 56 intersects inlet port 24 and the low pressure side of pump cavities 27 and 28, and a liquid outlet channel 57 intersects liquid outlet port 25 and the high pressure side of pump cavities 27 and 28. Channel 56 is larger in diameter than channel 57. Rotation of gears 29 and 30 in the direction shown in FIG. 2 produces a pumping action in the well known manner. The higher pressure on the outlet side of cavities 27 and 28 causes a force to be exerted on gears 29 and 30 biasing the gears toward the low pressure side of the cavities. As shown in FIG. 3, a portion of channel 57 in end cap 7 is connected to bearing holes 37 and 40 by a forced lubrication channel 58. A ball 59 or other suitable means plugs the end of channel 58.

The clearance space 31 between the tips of gears 29 and 30 and the surface of cavities 27 and 28 is closed in predetermined locations by a pair of identical tip seals 60 in accordance with the teachings of this invention. Tip seals 60 are located immediately adjacent to the edges of inlet chamber 56 in a first circular hole 61 which intersects pump cavities 27 below inlet channel 56 and a second circular hole 62 which intersects pump cavity 28 above inlet channel 56. Each tip seal is shaped like a right circular cylinder that has been truncated on one side where it intersects a gear cavity so as to form an arcuate sealing surface 63. Thus surface 63 is a circular arc which is essentially a continuation of the surface of one of the cavities 27 or 28. Surfaces 63 protrude slightly into cavities 27 and 28 and extend along cavities 27 and 28 for a circumferential distance greater than the distance separating the tips of the teeth of gears 29 and 30 so that at least one tooth of each gear will always be in contact with its associated tip seal 60. The pressure differential between outlet chamber 57 and inlet chamber 56 creates a force sufficient to press the tips of the teeth of gears 29 and 30 into sliding sealing contact with seals 60. This prevents loss of pressure and escape of liquid from the high pressure side of pump 5 to the low pressure side.

Tip seals 60 are made from a relatively soft material capable of providing a sliding seal with the hard metal tips of gears 29 and 30. Durable, corrosion resistant plastics, such as virgin Teflon and Rulon LD, are ideal materials. Seals 60 are dimensioned to slip fit into their holes 61 and 62. Each tip seal 60 has a circular hole 64 passing through it. When seals 60 are made from relatively resilient materials such as Teflon, they can be tightly locked into holes 60 and 62 by pressing an oversized cylindrical locking pin 65 into each hole 64. Pin 65 expands its seal 60 radially against the surface of holes 61 and 62 and locks seal 60 in place. If seals 60 are made from an inexpandable material the seals should be dimensioned for a press fit into holes 61 and 62. Wear of tip seals 60 is controlled by slow bearing wear resulting in a wear compensating low friction hydraulic seal.

The outlet side of pump 5 is connected to the inlet side by a bypass arrangement that is adjustable at all times, including while pump 5 is running. Outlet channel 57 passes completely through body 6, thus venting one of its ends into end cap 8. A liquid return passage 69 connects the inside of cap 8 to inlet channel 56. A cupped bypass closure valve 70 has a surface 71 that seals against the end of channel 56 around passage 69 and a stem 72 that passes through and beyond a guide 73. A coil spring 75 encircles stem 72 and bears against guide 73, which forces surface 71 into sealing contact around passage 69. The force exerted by spring 75, and hence the pressure at which passage 69 opens, is determined by the location of a shoulder 76 on adjusting screw 77. Screw 77 is threaded into a tapped hole passing through a cap nut 78, which is threaded into a tapped hole 79 in end cap 7. An annular seal 81 is forced against the bottom of hole 79 and around the shank of screw 77 by tightening of nut 78. Turning of screw 77 advances or retracts shoulder 76, thus compressing or permitting expansion of spring 75, and setting the pressure at which bypass passage 69 will vent liquid from outlet channel 57 into inlet channel 56.

One commercially produced example of a small precision gear pump constructed essentially as shown in the drawing had gears 29 and 30 0.500 inches in diameter and tip seals 60 0.218 inches in diameter. Holes 64 were 0.078 inches in diameter and locking pins 65 were 0.095 inches in diameter. An 1/20 H.P., a.c. electric motor rotating a magnetic drive mechanism as described herein caused gears 29 and 30 to turn at 3200 r.p.m. This pump produced pressures up to 125 psig, flow rates up to 40 gallons per hour and an inlet vacuum to 28 in. hg. Its parts were made from stainless steel, carbon, and Teflon, as described herein, and the pump was usable to pump liquids having temperatures in the range from −100° F to +300° F. The pump was self-priming and capable of running dry, with liquid-gas mixtures, or with non-lubricating liquids such as water. It was capable of outstanding leak-proof service in such critical uses as pumping dialysate for humans in medical equipment like artifical kidney dialysate systems.

It has thus been shown that by the practice of this invention, a durable, high capacity, leak-proof gear pump employs tip-seals that compensate for the wear of its parts. The gear shaft bearings and tip seals are made from relatively softer materials than the metal gears and shafts; but as the softer parts wear away, the greater pressure on the outlet side of the pump continues to force the gear tips against seals 60. This prevents internal circumferential leakage and loss of pressure and pumping capacity. Since the hard metal gears have a long life, only the relatively inexpensive and easily replaceable tip seals and bearings are expendable.

While the present invention has been described with reference to a particular embodiment, it is not intended to illustrate or describe herein all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of the invention.

What is claimed is:

1. A magnetically driven gear pump isolated from its power source in a sealed housing comprising, a pair of gear cavities in said housing; a pair of essentially identical, circular toothed, hard metal mating gears, one of which is in each gear cavity; a rotatable axial shaft passing through the center of one of said gears; said shaft having a magnet on its end; power driven magnetic means external of said housing for turning said magnet and said one gear; the other gear being mounted on another shaft and the ends of each shaft extending beyond its gear, said shaft ends being received in sleeve bearings that are substantially softer than said gears and shaft ends; an inlet chamber and an outlet chamber in said housing on opposite sides of said gears; the pressure in said inlet chamber being lower than the pressure in said outlet chamber whereby said gears are biased toward said inlet chamber; a first tip seal hole in said housing below said inlet chamber and communicating with one of said gear cavities, and a second tip seal hole in said housing above said inlet chamber and communicating with the other of said gear cavities; a separate, removable stationary gear tip seal made from a non-metallic material substantially softer than said gears filling each tip seal hole and protruding slightly into said gear cavities, said tip seal being shaped like a truncated right circular cylinder which intersects one of said gear cavities, and the surface of said tip seal contacted by gear teeth being shaped like an arc of such circular gear cavity, said tip seal extending for a distance greater than the circumferential separation of the tips of the teeth of its associated gear, whereby at least one tooth of a gear will be biased against each tip seal so as to prevent leakage of liquid from said outlet chamber to said inlet chamber.

2. The invention defined in claim 1 wherein each tip seal has a circular hole through its longitudinal central axis, and a lock pin pressed into said hole holds each tip seal in its cavity.

3. The invention defined in claim 2 wherein said lock pin is larger in diameter than said circular hole and thereby expands said tip seal into a tight friction fit against the surface of its tip seal cavity.

4. The invention defined in claim 1 wherein said housing comprises a body containing said gears and said tip seals, first and second end caps, each of which is attached to said body so as to compress an a seal therebetween, a high pressure passage connecting said outlet chamber to the inside of said second end cap, a liquid return passage connecting said inlet passage to the inside of said second end cap, a spring-biased bypass closure valve sealing said liquid return passage, and an adjusting screw threaded through said first end cap and bearing against said spring so as to vary the force exerted against said valve and consequently the pressure at which liquid from said outlet chamber will be vented back into said inlet chamber.

5. A magnetically driven gear pump isolated from its power source in a sealed housing comprising a pair of circular gear cavities in said housing; a pair of essentially identical circular, toothed hard metal mating gears, one of which is in each gear cavity, there being a clearance space between the tip of each gear tooth and the surface of its gear cavity; a rotatable axial metal shaft passing through the center of one of said gears, said shaft having a magnet on its end; power driven magnetic means external of said housing for turning said magnet and said one gear, the other gear being mounted on another metal shaft and the ends of each shaft extending beyond its gear, said shaft ends being received in sleeve bearings that are substantially softer than said metal shafts and gears; an inlet chamber and an outlet chamber in said housing on opposite sides of said gears; the pressure in said inlet chamber being lower than the pressure in said outlet chamber whereby said gears are biased toward said inlet chamber; a first tin seal hole in said housing below and immediately adjacent said inlet chamber and communicating with one of said gear cavities, and a second tip seal hole in said housing above and immediately adjacent said inlet chamber and communicating with the other of said gear cavities; a separate, removable non-metallic, stationary gear tip seal substantially softer than said gears filling each tip seal cavity and protruding a distance greater then said clearance space into said gear cavities, each tip seal having a circular hole through it, a metal lock pin larger in diameter than said circular hole being pressed thereinto so as to expand said tip seal into a tight friction fit against the surface of said tip seal hole, each tip seal being shaped like a right circular cylinder which intersects one of said gear cavities and is truncated on one side to define a surface shaped like a circular arc of a gear cavity, the arcuate surface of each tip seal extending for a distance greated than the circumferential separation of the tips of the teeth of each gear, whereby at least one tooth of a gear will be biased against each tip seal so as to prevent leakage of liquid from said outlet chamber to said inlet chamber; and said housing comprising a body containing said gears and said tip seals, first and second end caps, each of which is attached to said body so as to compress a seal therebetween, a high pressure passage connecting said outlet chamber to the inside of said second end cap, a liquid return passage connecting said inlet passage to the inside of said second end cap, a spring-biased bypass closure valve sealing said liquid return passage, and an adjusting screw threaded through said first end can and bearing against said spring so as to vary the force exerted against said valve and consequently the pressure at which liquid from said outlet chamber will be vented back into said inlet chamber.

* * * * *

UNITED STATES PATENT OFFICE
CERTIFICATE OF CORRECTION

Patent No. 4,065,235 Dated December 27, 1977

Inventor(s) Donn Breen Furlong & Dickey Steele Londahl

It is certified that error appears in the above-identified patent and that said Letters Patent are hereby corrected as shown below:

Assignee: Tuthill Pump Company of California

San Rafael, CA

Column 6, line 6, "tin" should read --tip--.

Signed and Sealed this

Ninth Day of May 1978

[SEAL]

Attest:

RUTH C. MASON
Attesting Officer

LUTRELLE F. PARKER
Acting Commissioner of Patents and Trademarks